US012790731B2

(12) United States Patent
Bogren et al.

(10) Patent No.: US 12,790,731 B2
(45) Date of Patent: Nov. 10, 2026

(54) COMPOSITE NONWOVEN SHEET MATERIAL

(71) Applicant: Essity Hygiene and Health Aktiebolag, Gothenburg (SE)

(72) Inventors: Maria Bogren, Gothenburg (SE); Mikael Strandqvist, Gothenburg (SE); Hannu Ahoniemi, Gothenburg (SE)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 35 days.

(21) Appl. No.: 17/596,229

(22) PCT Filed: Oct. 11, 2019

(86) PCT No.: PCT/SE2019/051000
§ 371 (c)(1),
(2) Date: Dec. 6, 2021

(87) PCT Pub. No.: WO2021/010875
PCT Pub. Date: Jan. 21, 2021

(65) Prior Publication Data

US 2022/0298686 A1 Sep. 22, 2022

(30) Foreign Application Priority Data

Jul. 18, 2019 (WO) ..... PCT/SE2019/050700

(51) Int. Cl.
*D04H 1/4374* (2012.01)
*D04H 1/26* (2012.01)
(Continued)

(52) U.S. Cl.
CPC ..... *D04H 1/4374* (2013.01); *D04H 1/26* (2013.01); *D04H 1/4291* (2013.01);
(Continued)

(58) Field of Classification Search
CPC ..... D04H 1/4374; D04H 1/26; D04H 1/4291; D04H 1/435; D04H 1/43838; D04H 1/498; D04H 5/03; D04H 1/732
See application file for complete search history.

(56) References Cited

U.S. PATENT DOCUMENTS 3,849,241 A 11/1974 Butin et al.
4,048,364 A 9/1977 Harding et al.
(Continued)

FOREIGN PATENT DOCUMENTS

CA 841938 A 5/1970
CN 1171463 A 1/1998
(Continued)

OTHER PUBLICATIONS

English Machine Translation of JPH 06299456 by google scholar, translated Nov. 7, 2023.*
(Continued)

*Primary Examiner* — Jennifer A Gillett
(74) *Attorney, Agent, or Firm* — Buchanan Ingersoll & Rooney PC

(57) ABSTRACT

A composite nonwoven sheet material comprising a reinforcement layer comprising mainly reinforcement filaments, a pulp layer comprising mainly pulp fibers, and a surface layer comprising mainly microfibers, wherein the pulp layer is interposed between the reinforcement layer and the surface layer, and wherein the pulp fibers are entangled with the reinforcement filaments and the microfibers. A process of producing a composite nonwoven sheet material, comprising: forming a fibrous web comprising a reinforcement layer comprising mainly reinforcement filaments, a pulp layer comprising mainly pulp fibers, and a surface layer comprising mainly microfibers, wherein the pulp layer is interposed between the reinforcement layer and the surface layer; and
(Continued)

hydroentangling the fibrous web to form the composite nonwoven sheet material.

20 Claims, 4 Drawing Sheets

(51) Int. Cl.

| | |
|---|---|
| ***D04H 1/4291*** | (2012.01) |
| ***D04H 1/435*** | (2012.01) |
| ***D04H 1/4382*** | (2012.01) |
| ***D04H 1/498*** | (2012.01) |
| ***D04H 1/732*** | (2012.01) |
| ***D04H 5/03*** | (2012.01) |

(52) U.S. Cl.
CPC ..... *D04H 1/435* (2013.01); *D04H 1/43838* (2020.05); *D04H 1/498* (2013.01); *D04H 1/732* (2013.01); *D04H 5/03* (2013.01)

(56) References Cited

U.S. PATENT DOCUMENTS

| | | | | |
|---|---|---|---|---|
| 4,813,864 | A | 3/1989 | Balk | |
| 5,026,587 | A * | 6/1991 | Austin | D04H 1/492 428/137 |
| 5,545,371 | A | 8/1996 | Lu | |
| 5,899,785 | A | 5/1999 | Groten et al. | |
| 5,952,251 | A | 9/1999 | Jackson et al. | |
| 6,028,018 | A | 2/2000 | Amundson et al. | |
| 6,110,588 | A * | 8/2000 | Perez | D01D 5/423 428/397 |
| 6,836,937 | B1 | 1/2005 | Boscolo | |
| 7,998,889 | B2 | 8/2011 | Stralin et al. | |
| 2003/0118776 | A1 | 6/2003 | Anderson et al. | |
| 2005/0091811 | A1* | 5/2005 | Billgren | D04H 5/02 28/104 |
| 2005/0092417 | A1* | 5/2005 | Billgren | D04H 1/732 156/62.2 |
| 2005/0136772 | A1 | 6/2005 | Chen et al. | |
| 2008/0318487 | A1* | 12/2008 | Pedoja | D04H 13/00 264/119 |
| 2010/0159775 | A1 | 6/2010 | Chambers et al. | |
| 2010/0249741 | A1* | 9/2010 | Fingal | D04H 5/03 604/385.01 |
| 2013/0189892 | A1* | 7/2013 | Boscolo | D01D 5/092 442/337 |
| 2013/0260116 | A1* | 10/2013 | Kawashima | D21H 21/14 427/434.2 |
| 2013/0270812 | A1* | 10/2013 | Murakami | B42D 25/475 156/253 |
| 2016/0009093 | A1* | 1/2016 | Andrew | D04H 1/492 15/210.1 |
| 2018/0363177 | A1 | 12/2018 | Strandqvist | |

FOREIGN PATENT DOCUMENTS

| | | | | |
|---|---|---|---|---|
| CN | 108261287 | A | 7/2018 | |
| CN | 108291343 | A | 7/2018 | |
| CN | 208533052 | U | 2/2019 | |
| CN | 209292619 | U | 8/2019 | |
| DE | 19917275 | A1 | 10/2000 | |
| JP | H06299452 | A | 10/1994 | |
| JP | H06299456 | A | 10/1994 | |
| JP | 2005029923 | A | 2/2005 | |
| JP | 4146305 | B2 | 9/2008 | |
| JP | 2018016907 | A | 2/2018 | |
| JP | 2018193634 | A | 12/2018 | |
| JP | 2019115388 | A | 7/2019 | |
| KR | 20160013773 | A * | 2/2016 | D04H 1/49 |
| WO | 9307323 | A1 | 4/1993 | |
| WO | 9803713 | A1 | 1/1998 | |
| WO | 2005065516 | A2 | 7/2005 | |
| WO | 2005072115 | A2 | 8/2005 | |
| WO | 2005072115 | A3 | 7/2006 | |
| WO | 2005065516 | A3 | 1/2007 | |
| WO | 2007070145 | A1 | 6/2007 | |
| WO | 2009031951 | A1 | 3/2009 | |
| WO | 2013160553 | A1 | 10/2013 | |
| WO | 2015066261 | A1 | 5/2015 | |
| WO | 2017095483 | A1 | 6/2017 | |
| WO | WO-2018199975 | A1 * | 11/2018 | D21H 27/00 |

OTHER PUBLICATIONS

English Machine Translation of KR 2016-0013773.*

Office Action (Notification of the Second Office Action) issued on Jan. 10, 2023, by the Chinese Patent Office in Chinese Patent Application No. 201980097620.2, and an English Translation of the Office Action. (15 pages).

Office Action (Notification of the First Office Action) issued on Aug. 29, 2022, by the Chinese Patent Office in corresponding Chinese Patent Application No. 201980097620.2, and an English Translation of the Office Action. (15 pages).

Supplemental European Search Report issued on Jun. 12, 2023, by European Patent Office in European Patent Application No. 19 93 7722 (6 pages).

International Search Report (PCT/ISA/210) and Written Opinion (PCT/ISA/237) mailed on Mar. 18, 2020, by the Swedish Patent Office as the International Searching Authority for International Application No. PCT/SE2019/051000.

Office Action (Decision of Rejection) issued on Mar. 29, 2023, by the Chinese Patent Office in corresponding Chinese Patent Application No. 201980097620.2, and an English Translation of the Office Action. (13 pages).

Office Action issued on Nov. 5, 2024, by the Mexican Patent Office in corresponding Mexican Patent Application No. MX/a/2021/015746, and an English Translation of the Office Action. (16 pages).

* cited by examiner

Fig. 2
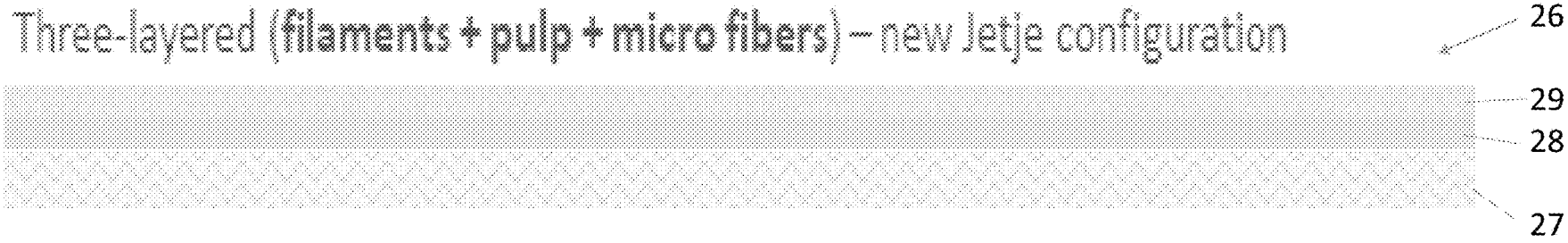
Fig. 4 : four layers (pulp + filaments + pulp + microfibers)
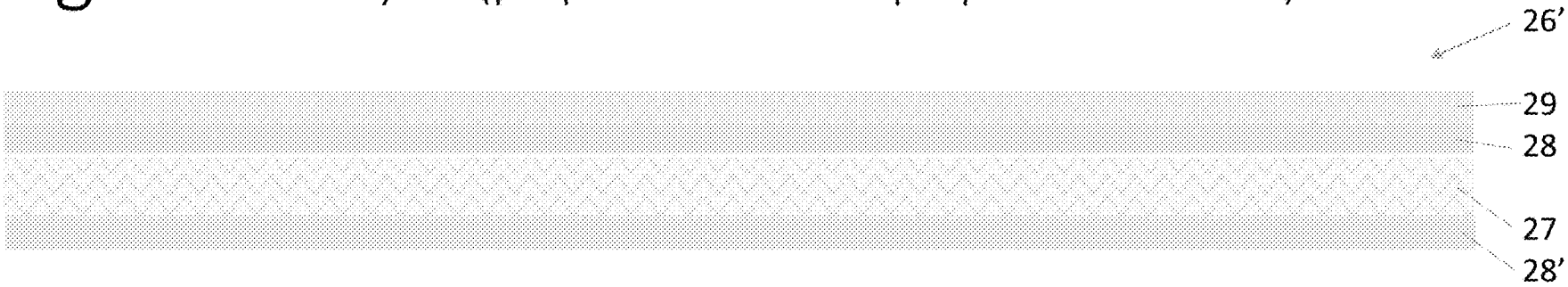

COMPOSITE NONWOVEN SHEET MATERIAL

TECHNICAL FIELD

The present disclosure relates to sheets of composite nonwoven material processes of producing such sheets.

BACKGROUND

Absorbent nonwoven sheets are used for wiping various types of spills and dirt in industrial, medical, office and household applications. Nonwoven sheets typically comprise a combination of synthetic fibers and cellulosic pulp for absorbing water, hydrophilic substances, or hydrophobic substances such as oils or fats, for example. In addition to sufficient strength, sheets used for wiping require sufficient absorptive power.

Some wiping material may include microfibers. Wiping material of that type has the advantage of facilitating deep cleaning as the microfibers are able to reach into pores and crevices of the surfaces being wiped. Additionally, wiping materials that include microfibers may be able to absorb liquids very quickly due to the high capillary forces present in of those materials, and may also have a very good dry-wiping ability capable of providing a dry and clean surface after use.

SUMMARY

The present disclosure provides, in one aspect, a composite nonwoven sheet material as defined in the first independent claim, in particular comprising a reinforcement layer comprising mainly reinforcement filaments, a pulp layer comprising mainly pulp fibers, and a surface layer comprising mainly microfibers, wherein the pulp layer is interposed between the reinforcement layer and the surface layer, and wherein the pulp fibers, the microfibers, and the reinforcement filaments are entangled with each other.

The inventors have surprisingly found that a material having a pulp layer interposed between a reinforcement layer and a surface layer (microfibers) may result in an improved cleaning performance compared to conventional composite nonwoven sheet materials.

Without being bound by theory, the inventors believe that the improved cleaning performance may result from the combination of capillary action provided by the microfibers at the surface of the sheet material, and the enhanced liquid absorption and release properties of the pulp layer in contact with the microfibers.

Embodiments of the composite nonwoven sheet material are defined in dependent claims.

The present disclosure provides, in another aspect, a process of producing a composite nonwoven sheet material, as defined in the second independent claim, in particular comprising the steps of: forming a fibrous web comprising a reinforcement layer comprising mainly reinforcement filaments, a pulp layer comprising mainly pulp fibers, and a surface layer comprising mainly microfibers, wherein the pulp layer is interposed between the reinforcement layer and the surface layer; and hydroentangling the fibrous web to form the composite nonwoven sheet material.

Embodiments of the process of producing the composite nonwoven sheet material are defined in dependent claims.

BRIEF DESCRIPTION OF THE DRAWINGS

The present material and process will be further described with reference to some embodiments shown in the accompanying drawings:

FIG. 2 is a schematic cross-sectional view of a composite nonwoven sheet material in accordance with one embodiment of the disclosure.

FIG. 4 is a view similar to FIG. 2, schematically showing a composite nonwoven sheet material in accordance with another embodiment of the disclosure.

DETAILED DESCRIPTION OF PARTICULAR EMBODIMENTS

Figure 1:
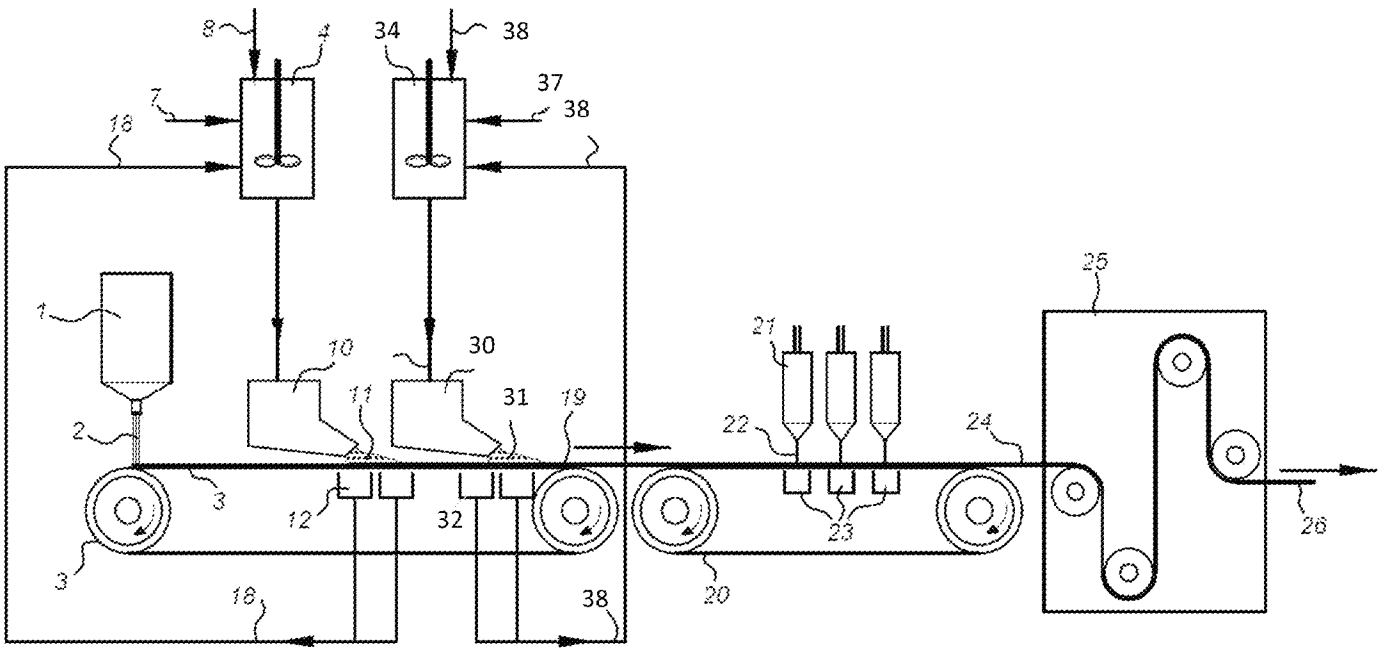
FIG. 1 is a schematic representation of a production line for producing a composite nonwoven sheet material in accordance with one embodiment of the disclosure.

The present disclosure will be described with respect to particular embodiments and with reference to certain drawings but the disclosure is not limited thereto but only by the claims. The drawings described are only schematic and are non-limiting. In the drawings, the size of some of the elements may be exaggerated and not necessarily drawn to scale for illustrative purposes. The dimensions and the relative dimensions do not necessarily correspond to actual reductions to practice of the disclosure.

Furthermore, the terms "first," "second," "third," and the like in the description and/or in the claims, are used for distinguishing between similarly identified elements and are not necessarily intended to connote a sequential or chronological order. Those terms are interchangeable under appropriate circumstances and the embodiments may be able to operate in sequences other than those described or illustrated herein.

Moreover, the terms "top," "bottom," "over," "under," and the like in the description and/or the claims are used for descriptive purposes only and do not necessarily to describe absolute, definite positions, but rather relative positions. Those terms so used are interchangeable under appropriate circumstances and the embodiments of the disclosure described herein may operate in orientations other than those described or illustrated herein.

Furthermore, the various embodiments, even if referred to as "preferred," are to be construed as merely illustrative manners in which the disclosure may be implemented, and are therefore not intended to limit the scope of the present disclosure.

The disclosure pertains to a composite nonwoven sheet material and further pertains to a process of producing such composite nonwoven sheet material. The disclosure also pertains to a wipe comprising such composite nonwoven sheet material and to the use of such composite nonwoven sheet material. Specific embodiments are set forth throughout the present disclosure, and each combination of such embodiments is expressly contemplated in the present disclosure. The of those embodiments are further explained in the following description, including the cited examples, as well as in the drawings.

The composite nonwoven sheet material according to the present disclosures includes pulp fibers, a reinforcement material comprising mainly reinforcement filaments, and microfibers. The microfibers are in an outer or surface layer of the sheet material and is primarily made up of the microfibers. A pulp layer, which is primarily made up of the pulp fibers, is interposed between the surface layer and the reinforcement layer. The pulp fibers and the microfibers penetrate the reinforcement layer, and in particular embodiments are entangled with the reinforcement filaments of the reinforcement layer. As a result, the pulp layer and the microfiber surface layer are effectively bonded to the reinforcement layer, while the different layers are still discernible from one another.

As used herein, the term "ply", refers to a single layer or a combination of two or more layers that are strongly interconnected. For example, a ply may include several layers that are interconnected by (hydro)entangling their respective fibers or filaments. End products such as wipes may be made of one or several plies, and each of those plies may in turn be made up of one or more layers. In materials made up of two or more plies, those plies may be fixed to each other by means of adhesive, embossing, thermal bonding, point bonding, ultrasonic bonding, or other techniques known in the art.

As used herein, the term "surface layer" refers to the effective surface of the sheet material or of the end product i.e., the front side or back side of the sheet material or end product.

Where weight ratios or percentages are mentioned herein, these are on dry matter basis (without any water or more volatile substances), unless otherwise specified. Where water weights or percentages are mentioned herein, these are on wet matter basis.

In the present disclosure ranges specified as "x-y," "between x and y," "from x to y," and the like (with "x" and "y" being numerals), are considered to be synonymous, and the inclusion or exclusion of the precise end points x and y are considered to be of theoretical rather than practical meaning.

Dtex is a unit to measure the linear mass density of a fiber or filament, and is defined as the mass in grams per 10 000 meters.

Reinforcement Layer

The reinforcement layer within the scope of the present disclosure may for example include synthetic filaments. A filament is a type of elongated fiber i.e., one that, in proportion to its diameter, is very long, in principle endless during its production. Filaments may be produced by melting and extruding a thermoplastic polymer through fine nozzles, followed by cooling, preferably using an air flow, and solidification into strands that may then be treated by drawing, stretching or crimping. Melt blown filaments are produced by extruding molten thermoplastic polymer through fine nozzles in very fine streams and directing converging air flows towards the polymers streams so that they are drawn out into continuous filaments with a very small diameter. Production of melt blown is e g described in U.S. Pat. Nos. 3,849,241 or 4,048,364. The fibers can be microfibers or macrofibers depending on their dimensions. Microfibers have a diameter of up to about 20 μm, usually about 2 to about 12 μm. Macrofibers have a diameter of over about 20 μm, usually about 20 to about 100 μm. Spun-bond filaments are produced in a similar manner by stretching the fibers using air to provide an appropriate fiber diameter that is usually at least about 10 μm, usually between about 10 and about 100 μm. Illustrative methods for producing spun-bond filaments are provided in U.S. Pat. Nos. 4,813,864 and 5,545,371. Chemicals may be added to the surface of the filaments in order to achieve additional properties or functionality.

Spun-bond and melt-blown filaments jointly define a group of filaments referred-to as "spun-laid filaments," which are made by a process that includes directly depositing the fibers in situ, onto a moving surface, to form a web that is subsequently bonded. Controlling extrusion and thereby formation of the filaments may include controlling the 'melt flow index' by the choice of polymers and temperature profile. Spun-bond filaments normally are stronger and of a greater consistency than other types of filaments. In particular embodiments, filaments are laid lengthwise.

Any thermoplastic polymer that has sufficient coherent properties to allow processing in the molten state may in principle be used for producing spun-bond fibers. Examples of useful synthetic polymers are polyolefins, such as polyethylene and polypropylene, polyamides such as nylon-6, polyesters such as poly(ethylene terephthalate) (PET) and polylactides. Polyethylene (PE) and polypropylene (PP) are particularly suitable thermoplastic polymers for use as a reinforcement material. Polylactides are especially suitable for applications where bio-degradability is required. Copolymers and mixtures of these polymers may of course also be used, as well as natural polymers with thermoplastic properties. Polyolefins may be produced both from fossil as well as renewable sources.

Pulp Fibers

Many types of pulp fibers may be used within the scope of the present disclosure, especially those having a capacity to absorb water. An example of suitable pulp fibers is cellulose pulp fibers. Cellulose pulp fibers may be selected from any type of pulp and blends thereof. In particular embodiments, the pulp is characterized by being entirely natural cellulosic fibers and may include wood fibers and/or cotton fibers. Specifically, the pulp fibers may be softwood papermaking pulp, although hardwood pulp and non-wood pulp, such as hemp and sisal may be used. The length of pulp fibers may vary from less than about 1 mm for hardwood pulp and recycled pulp, to up to about 6 mm for certain types of softwood pulp. Recycled fibers, on the other hand, may have various lengths, and even include lengths shorter than about 1 mm.

Pulp fibers used in the embodiments described in the present disclosure may have a length between about 1 mm and about 6 mm, for example specifically between about 2 mm and about 5 mm, and for example more specifically between about 3 mm and about 4 mm.

The pulp fibers may be mixed with additional particles or additional fibers such as coarse staple fibers, for example. Such coarse staple fibers may have mass densities of more than about 1 dtex, for example between about 1.1 and about 10 dtex, specifically between about 1.2 and about 6 dtex, and lengths of up to about 40 mm, for example. Specifically, they may have lengths between about 2 and about 30 mm, for example. In such mixtures, the content of pulp fibers may be above about 50 wt. %, above about 60 wt. %, or between about 70 wt. % and about 95 wt. %.

Microfibers

Microfibers are synthetic fibers having a mass density of about 1 dtex or less than about 1 dtex. The diameter of a microfiber depends on the density of the fiber. Thus, a 1 dtex microfiber of polypropylene (PP) has a diameter of about 12 μm when calculated for round solid fibers. A 1 dtex microfiber of polyamide (PA) has a diameter of about 11 μm when calculated for round solid fibers. A 1 dtex microfiber of PET, PET/PA mixtures or polylactides has a diameter of about 10 pm when calculated for round solid fibers. The minimum mass density of the microfibers may typically be about 0.05 dtex. In particular embodiments, the microfibers may have a mass density of from about 0.1 dtex up to about 0.5 dtex, from about 0.12 dtex up to about 0.4 dtex, or from about 0.15 dtex to about 0.35 dtex.

The length of a microfiber may be about 18 mm or shorter, down to about 1 mm. Such length may for example be between about 2 mm and about 10 mm, or between about 3 mm and about 7 mm.

Microfibers may include polymer microfibers such as polyester (e.g.,PET, polylactide), polypropylene, and/or polyamide microfibers.

Splittable fibers may also be considered for providing microfibers. Suitable splittable fibers include polyethylene-polypropylene, polypropylene-polyester, polypropylene-polyamide, and polyethylene-terephthalate-polyamide (PET-PA) bicomponent fibers. Tricomponent or higher multicomponent fibers are contemplated as well. For splittable bicomponent or multicomponent fibers, the affinity between the different polymers is controlled carefully such that the polymers will hold together during one part of the product forming process and separate to the desired degree in the latter part of the product forming process. Affinity is adjusted by choosing polymers of suitable chemical type having suitable molecular weights, and/or with suitable physical properties. The affinity may also be adjusted by other means such as through the addition of chemicals to the polymer melts that will affect the surface properties of the polymers.

The fibers may be split by a number of different methods such as heat treatment by hot air, water or steam, chemical disintegration of the boundary surface by chemical leaching or plasma treatment, mechanical stressing by physical drawing or bending, or by water jet impingement, such as hydroentangling. This may be done during fiber production, during web preparation, during web consolidation, during web drying, and/or during web post-treatment. In specific embodiments, splitting (e.g., partial splitting) by hydroentanglement during web consolidation has been found to be particularly beneficial.

The splitting of a fiber will normally proceed stepwise, with one internal surface between the segments breaking up at a time i.e., if the splittable fiber has more than two segments many variants of partly split fibers will coexist.

One advantage of using splittable fibers that are split in the latter stages of a web production process is that during the earlier stages of the process fewer fibers will have to be handled. The fewer fibers handled will also be of a larger diameter, which greatly reduces the mechanical and process load.

The splitting of the fibers provides finer fiber segments that in turn form the microfibers in the final products, thus making it possible to enhance the desired product characteristics.

Sheet Characteristics

The composite nonwoven sheet material as disclosed herein may have a total basis weight ranging between about 20 g/m$^2$ and about 120 g/m$^2$, more specifically between about 50 g/m$^2$ and about 100 g/m$^2$, as more specifically about 80 g/m$^2$, for example.

The composite nonwoven sheet material in the embodiments of the present disclosure may include between about 25 wt. % and about 80 wt. % of pulp fibers, between about 10 wt. % and about 40 wt. % of a reinforcement material, and between about 10 wt. % and about 40 wt. % of microfibers.

In specific embodiments, the composite nonwoven sheet material includes between about 30 wt. % and about 75 wt. % of pulp fibers (for example between about 40 wt. % and about 65 wt. % of pulp fibers), between about 10 wt. % and about 35 wt. % of reinforcement material (for example between about 15 wt. % and about 30 wt. % of the reinforcement material), and between about 10 wt. % and about 35 wt. % of microfibers (for example between about 15 wt. % and about 30 wt. % of microfibers).

When the sheet material also includes coarse staple fibers such as in a mixture with pulp fibers as described above, the content of the coarse staple fibers may be for example in the range between about 1 wt. % and about 30 wt. %, specifically between about 2 wt. % and about 20 wt. %, and more specifically between about 4 wt. % and about 15 wt. %, of the combined total of pulp, reinforcement material (filaments), microfibers and coarse staple fibers. The corresponding proportion of pulp fibers may then be for example between about 20 wt. % and about 75 wt. %, specifically between about 25 wt. % and about 70 wt. %, and more specifically between about 30 wt. % and about 60 wt. %, of the combined total.

The staple fibers might also have different cross sectional shapes apart from round. For example, they may have a trilobal cross-sectional shape.

The composite nonwoven sheet material as disclosed herein may have two different sides or surfaces, each having a different surface structure e.g., the microfiber layer forming a top side and the reinforcement layer forming a bottom side of the sheet material. The microfiber layer top side may have a relatively soft and smooth surface as compared to the bottom side. A wipe made of such material and having such a soft and smooth surface has a leveled and consistent texture with few or no irregularities or projections that may be felt by the hand of a person having tactile contact with that surface.

In specific embodiments, the composite nonwoven sheet material may be provided with an additional layer on the opposite side of the reinforcement layer to provide a different surface texture on the opposite side or opposite layers. For example, that opposite side may have a rougher or more abrasive surface, for example formed by another pulp layer at the bottom side of the reinforcement layer. As a result, the wipe may be provided with bifunctional characteristics, thus enhancing versatile use for cleaning applications. The soft and smooth microfiber layer top side may be efficient in deep cleaning and is also suitable for polishing purposes. The rough and abrasive pulp layer bottom side may be more suitable for scrubbing. The pulp layers on both sides of the reinforcement layer may have the same properties (e.g., material, thickness) or properties that differ from one another.

In other embodiments the composite nonwoven sheet material may be provided with additional layers on the opposite side of the reinforcement layer to provide a mirror image of the layered structures on both sides of the reinforcement layer.

The composite nonwoven sheet material may have a liquid absorption capacity ranging between about 4 g liquid/g composite nonwoven sheet material and about 10 g liquid/g composite nonwoven sheet material, specifically between about 4.5 and about 9 g liquid/g composite nonwoven sheet material, more specifically between about 5 and about 8 g liquid/g composite nonwoven sheet material, even more specifically between about 5.5 and about 7 g liquid/g composite nonwoven sheet material, for example about 6 g liquid/g composite nonwoven sheet material. The liquid absorption capacity is measured using the method described below.

The contemplated composite nonwoven sheet material may have a liquid release capacity ranging between about 30% and about 80%, specifically between about 40% and about 75%, and more specifically between about 50% and about 70%. The liquid release capacity is measured using the method described below.

Process of Producing a Composite Nonwoven Material Sheet

An illustrative process of producing a composite nonwoven material sheet of the type described above includes:

- forming a fibrous web that has a reinforcement layer primarily made up of reinforcement filaments, a pulp layer primarily made up of mainly pulp fibers, and a surface layer primarily made up of mainly microfibers. The pulp layer is interposed between the reinforcement layer and the surface layer. The process also includes
- hydroentangling the fibrous web to thereby form the composite nonwoven sheet material.

The fibrous web may be hydroentangled from the side of the microfiber surface layer or from the opposite side, or from both sides, either simultaneously or in subsequent steps.

In the process, the hydroentangled composite nonwoven material sheet may be subjected to one or more further process steps such as a drying step.

The formed fibrous web may be formed by different processes or variants thereof, of which some embodiments are further explained below.

In one embodiment, the process for forming the fibrous web includes providing a reinforcement layer comprising mainly reinforcement filaments,

- applying pulp fibers above the reinforcement layer by wet laying, dry laying or air laying, for forming the pulp layer;
- applying microfibers or splittable fibers for providing microfibers above the pulp layer by wet laying, dry laying or air laying, for forming the surface layer; and
- hydroentangling the reinforcement layer, pulp layer and surface layer to obtain the fibrous web.

The process for forming the fibrous web may further include hydroentanglement step after the application of the pulp fibers above the reinforcement layer and before the application of the microfibers or the splittable fibers for providing microfibers.

In one embodiment, the process for forming the fibrous web includes pre-integrating the web, by flushing the web with water jets on the moving fabric, prior to subjecting the fibrous web containing the reinforcement material, the pulp and the microfibers to the (final) hydroentanglement step. Pre-integration may be performed at any stage before final hydroentanglement, but, in particular embodiments, it is performed after the reinforcement filaments have been deposited. It may further be advantageous to perform pre-integration on a first moving fabric and transferring the web to a second moving fabric for hydroentangling. The second moving fabric may have a porosity that is lower than the porosity of the first moving fabric.

Providing Reinforcement Filaments

The reinforcement layer may be formed from filaments deposited by one of various spunlaid techniques known in the art. For example, the process for producing the reinforcement layer may include laying down filaments, for example spun-bond filaments, on an endless forming fabric i.e., a moving carrier belt, with excess air being sucked off through the forming fabric.

The filaments (continuous fibers) are laid onto a forming fabric, where they are allowed to form an unbonded web structure in which the filaments may move relatively free with respect to each other. This may be achieved, for example, by choosing a suitable distance between the nozzles and the forming fabric, so that the filaments have time to cool and thereby have a reduced level of tackiness before landing on the forming fabric. Alternatively, cooling of the filaments before they are laid on the forming fabric may be achieved by other means, such as by air, for example. The air used for cooling, drawing and stretching the filaments is sucked through the forming fabric. Vacuum may be used to suck off the air. As a further alternative, the filaments may be cooled by spraying water on them.

In specific embodiments, the filaments may be laid onto another layer or layers of fibers, for example on a layer that includes pulp fibers and/or on a layer that includes microfibers.

The deposition speed of the filaments may be higher than the speed of the forming fabric, so that the filaments may form irregular loops and bends as they are collected on the forming fabric to thereby form a randomized reinforcement material web. The basis weight of the reinforcement layer may be, in some embodiments, between about 2 $g/m^2$ and about 50 $g/m^2$.

Providing the Pulp Fibers and Providing the Microfibers

The pulp fibers may be deposited onto the reinforcement layer using one of various available techniques, such as wet-laying, foam-laying, or air-laying.

Similarly, the microfibers may be deposited onto the pulp layer using one of by various available techniques, such as wet-laying, foam-laying, air-laying, or dry laying.

In specific embodiments, pulp fibers and/or microfibers may also be deposited on the opposite side of the reinforcement layer in order to obtain a dual function composite nonwoven sheet material of the type described above. The process may further include hydroentanglement after deposition of the pulp fibers and/or microfibers onto the opposite side of the reinforcement layer.

Various techniques are contemplated for depositing pulp fibers and/or microfibers onto the reinforcement layer. Each such technique is discussed in detail below.

Wet-Laying

Pulp fibers as well as microfibers may be slurried and papermaking additives such as wet and/or dry strength agents, retention aids, or dispersing agents may be added to produce a slurry of pulp fibers in water or a slurry of microfibers in water. The slurry is evenly distributed through a wet-laying head box onto a moving fabric, where it is laid down onto the reinforcement layer. The microfibers may be slurried in a similar manner and distributed through a headbox, where it is laid down onto the pulp layer.

Some of the pulp fibers or some of the microfibers will penetrate between the filaments, but the larger part will stay in their respective layer. The excess water is sucked through the web of filaments and down through the forming fabric, by means of suction boxes arranged under the forming fabric.

A particularly advantageous way of depositing the pulp fibers or the microfibers is in some embodiments is by foam formation, which is a variant of wet-laying, In that process, the cellulosic pulp or microfibers are mixed with water and air in order to form a three-phase suspension (foam), in the presence of a surfactant, for example between about 0.01 wt. % and about 0.1 wt. % of a non-ionic surfactant so as to form the pulp-containing mixture. The foam may contain between about 10 vol. % and about 90 vol. %, specifically between about 15 vol. % and about 50 vol. %, most specifically between about 20 vol. % and about 40 vol. % of air or other inert gas. The mixture is then transported to the headbox, which deposits the mixture on top of the filament web, while surplus water and air are sucked off.

It may be particularly advantageous in some embodiments when it is desirable to minimize surface irregularities and residual surfactant, to deposit the pulp and/or the micro filaments by foam-laying in two or more stages. Such a process involves using two consecutive head boxes, with intermittent removal of residual foam (surplus water and air), and may include a first foam formation stage, followed by a second foam formation stage, for example. An example of such process is described in WO2017/092791. If desired, residual foam removed from the foam-stage may be recycled to the foam-producing stage after de-aeration so as to facilitate recycling and to enhance total process efficiency.

Dry-Laying

In this type of process, which is an alternative to wet-laying, the fibers (e.g., microfibers) are d carded and then directly deposited onto the carrier.

Air-Laying

In this other type of process, which is an alternative to wet-laying, the fibers (e.g., pulp fibers, microfibers) are into an air stream and the air stream containing the fibers is directed toward the carrier, thereby forming a randomly oriented web).

Hydroentangling

The fibrous web comprising reinforcement filaments, pulp fibers and microfibers or splittable fibers for providing microfibers is hydroentangled and is mixed and bonded into a composite nonwoven material sheet. In case the fibrous web includes splittable fibers, a major portion of the splittable fibers will split during the hydroentanglement. The pulp fibers may penetrate the reinforcement layer and the microfibers penetrate may at least the pulp layer, and possibly also penetrate into the reinforcement layer. An illustrative description of a suitable hydroentangling process is provided in Canadian Patent no. 841,938.

Hydroentangling causes the different fiber types to be entangled by the action of a plurality of thin jets of high-pressure water impinging on the fibers. The fine mobile spun-laid filaments may be twisted around and entangled with one another and with the other fibers (primarily pulp fibers), which may result in a material with a very high strength in which all fiber types are intimately mixed and integrated. Entangling water is drained off through the forming fabric, and may be recycled, if desired, after purification (not shown). The energy supply needed for hydroentangling is relatively low. The energy supply at the hydroentangling may appropriately be in the interval of 150-700 kWh per ton of the treated material, measured and calculated as in the Canadian patent identified above.

The strength of a hydroentangled material will depend on the amount of entangling points formed, and thus on the length of the fibers. When filaments are used, the strength will be determined mostly on the filaments, and be reached fairly quickly in the entangling process. Thus, most of the entangling energy will be spent on mixing filaments and fibers to reach a good integration.

The reinforcement material may be substantially unbonded prior to the laying of the pulp-containing mixture and/or before the laying of the microfiber-containing mixture. The filaments of the reinforcement material may be largely free to move with respect to each other to allow mixing and twirling during entangling.

The entangling stage may include several transverse bars with rows of nozzles from which very fine water jets under very high pressure are directed against the fibrous web to provide entangling of the fibers. The water jet pressure may be profiled across rows of nozzles so that different pressures are present in the different rows of nozzles.

Alternatively, the fibrous web may be transferred to a second entangling fabric before hydroentangling. In this case, the web may also, prior to the transfer, be hydroentangled at a first hydroentangling station with one or more bars with rows of nozzles.

A majority of the entanglement/intertwining of the fibers will be produced as a result of the direct impact of the water jets onto the material, which is effective to transfer the kinetic energy from the water jet to the fibrous structure, which thereby makes the fibers and filaments entangle around themselves and with each other. Some of the entanglement may also come from the recoiling of the water jet against the surface on which the material is supported i.e., the forming fabric carrier (running wire). The more open the support is, the less recoiling and the greater the level of intertwining that results from the direct (initial) impact. On the other hand, a relatively dense support will result in more recoiling of the water jets, which causes intertwining from the opposite site of the jet impact. This recoiling impact may for example be useful when hydroentangling is desired also from the bottom side of the reinforcement layer e.g., when a pulp layer and/or a microfiber layer are provided also on the bottom side. Thus, in the case of entangling from the bottom side, a denser, but still sufficiently dewatering support facilitates a high level of recoiling, which is effective to cause the short fibers to penetrate the reinforcement layer. A relatively open support may have an open area of about 10% to about 25%, or about 12% to about 20%, of the support surface, and may have a permeability of about 200 cfm to about 600 cfm (cubic foot per min) (=about 5.7 $m^3$/min to about 17 $m^3$/min), or about 300 cfm to about 500 cfm (=about 8.5 $m^3$/min to about 14.2 $m^3$/min). A relatively dense support, on the other hand, may have an open area of about 3% to about 15%, or about 5% to about 10%, of the support surface, and a permeability in the order of about 50 cfm to about 300 cfm (=about 1.4 $m^3$/min to about 8.5 $m^3$/min), or about 100 cfm to about 200 cfm (=about 2.8 $m^3$/min to about 5.7 $m^3$/min). An example of the first, relatively open type, is a woven fabric from Albany International Corp., of Rohcester, NH, USA, and commercially available under the designation "310K." This fabric has an open area of about 15% and a hydroentanglement surface of about 58% i.e., a closed surface with correction for rounded i.e., scattering, surfaces. Examples of the second, relatively dense type, tend to have more metallic-like (i.e., less rounded surfaces), such as so-called nickel sleeves which are perforated steel cylinders onto which the material is hydroentangled, with typical open areas of nickel down to about 5%, and a flat i.e., recoiling area of up to about 90%. Herein, and "open area" means a proportion of the total area forming complete holes between upper and lower sides of the support.

Drying and Possible Further Process Steps.

The hydroentangled composite nonwoven material web may be dried, for example by using conventional web drying equipment, such as the type used for tissue drying, (e.g., through-air drying, Yankee drying). After drying, the material web may first be wound into mother rolls before being converted into desired formats. The structure of the material may be changed by further processing steps such as micro-creping, hot calendering, or embossing. Furthermore, one or more additives may be added to the material to impart specific properties desired in the final product. Such additives include, for example, wet strength agents, binder chemicals, latexes and debonders.

End Product

The composite nonwoven sheet material produced as described above has a layered structure that comprises at least three discernible layers or transactional regions: a reinforcement layer containing reinforcement filaments, a relatively pulp-rich layer above the reinforcement layer, preferably directly on top of the reinforcement layer, and a relatively microfiber-rich surface layer above the pulp-rich layer, preferably directly on top of the pulp-rich layer. The pulp fibers and microfibers may each penetrate the reinforcement layer, resulting in the layers (regions) remaining discernible e.g., by electron microscopy, but not having sharp transitions due to the entanglement of the fibers. The relatively pulp-rich layer contains at least about 50 wt. % of pulp fibers, or at least about 60 wt. % of pulp fibers or more, which proportions apply at least to about 10% of the cross-section of the material, or at least about 20% of the cross-section of the material. The relatively microfiber-rich surface layer contains at least about 50 wt. % of microfibers, or at least about 60 wt. % of microfibers or more, which proportions apply at least to the outermost about 5% of the cross-section of the material, or to the outermost about 10% of the cross-section of the material, at the top side. The degree of penetration may be such that the above percentages apply while the level of entanglement is sufficient for providing strength in that it is discernible by the reinforcement layer (filaments) not being completely separated from the pulp fibers and microfibers. The composite nonwoven sheet material may be converted to attain any desired shape, such as into rectangular sheets of between less than about 0.5 m up to several meters. Suitable examples include of lengths and widths between about 20 and about 80 cm, for example, between about 30 and about 60 cm. Suitable wipes have sizes of for example about 40 cm by about 40 cm. Depending on their intended use, they may have various thicknesses of for example between about 100 and about 2500 μm, in particular from about 250 to about 1500 μm. The wipes may be provided as dry wipes i.e., containing less than about 0.5 g water per g dry sheet material, or pre-wetted i.e., containing for example 1 to 6, and in particular from about 2 to about 4 g of water, and optionally containing surfactants, preservatives or other cleaning aids, per g of dry sheet material.

The nonwoven composite sheet material according to the present disclosure is suitable for various wiping applications in industrial, medical, office and/or household cleaning. The nonwoven composite sheet material may be particularly suitable for deep cleaning and/or for the cleaning of surfaces with a high hardness, such as surfaces having a high hardness and small cavities. Examples of hard surfaces include metal, polymer, glass, plexiglass and laminate surfaces. The nonwoven composite sheet material may permit cleaning into small cavities in which cellulose material is too large for deep cleaning. Furthermore, the nonwoven composite sheet material according to the present disclosure may allow thorough cleaning as a result of the high contact area of the material of the nonwoven composite sheet material and the surface to be cleaned and to the high volume of small pores resulting in a high capillary forces. Thorough cleaning may be particularly desirable for cleaning sanitizing surfaces, as well as for all cleaning applications within the health care sector.

Furthermore, the nonwoven composite sheet material according to the present disclosure may be suitable for cleaning surfaces that are susceptible of being scratched (including microscratching) when conventional materials are used for cleaning such surfaces.

DETAILED DESCRIPTION OF THE DRAWINGS

The accompanying FIG. 1 schematically illustrates equipment for carrying out an embodiment of the process of the present disclosure., in which a reinforcement material is first deposited, followed by foam laying of pulp fibers, foam laying of microfibers, and hydroentanglement. A revolving forming fabric 3 receives spunlaid filaments 2 from a spunlaying unit 1 to thereby define a web of those filaments 2. The forming fabric 3 with the web of filaments 2 supported on its surface is advanced to a first wet-laying stage in which a head box 10 deposits aqueous foam containing pulp fibers 11 onto the web. The aqueous foam is prepared in a mixing tank 4 that has inlets for a foamable liquid 7 and pulp fibers 8. Excess aqueous foam is drained through the forming fabric 3 by suction boxes 12, and may be de-aerated and returned via return pipe 18 to the mixing tank 4. Microfibers are wetlaid on top of the pulp fibers in a second wet-laying stage by a head box 30, which deposits aqueous foam containing microfibers or splittable fibers 31 to thereby define a web 19. The second aqueous foam is prepared in a second mixing tank 34 which has inlets for a foamable liquid 37 and microfibers or splittable fibers 36. Excess aqueous foam is drained through the forming fabric 3 by suction boxes 32, and may be de-aerated and returned via return pipe 38 to the second mixing tank 34. The web 19 is moved to a revolving fabric 20 in the machine direction (arrow) and subjected to hydroentanglement by water jets 22 produced by hydroentanglement devices 21. Spent water is collected in boxes 23 and carried off or recycled (not shown). The resulting integrated three-component material 24 is then moved to a drying stage 25, that for example includes an omega drier, and which finalizes the material to thereby form the nonwoven composite sheet material 26.

FIG. 2 schematically shows a cross-section of the nonwoven composite sheet material 26 that may be formed using the equipment of FIG. 1, and which comprises the reinforcement layer 27 containing reinforcement filaments, pulp layer 28 of which the pulp fibers are entangled with the reinforcement filaments of reinforcement layer 27, and microfiber surface layer 29, of which the microfibers are entangled with the pulp fibers of pulp layer 28.

Figure 3:
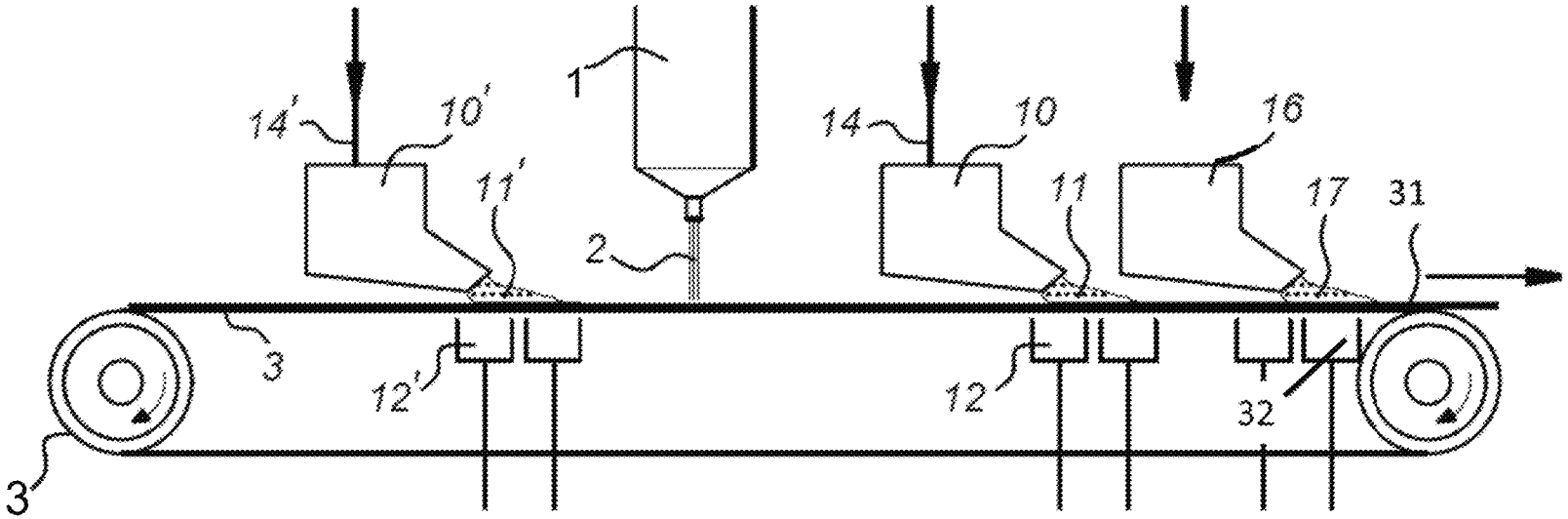
FIG. 3 is a view similar to FIG. 1, schematically showing a production line for producing a composite nonwoven sheet material in accordance with another embodiment of the disclosure.

FIG. 3 schematically illustrates equipment for carrying out another embodiment of the process of the present disclosure. In the shown process, a first layer of pulp fibers is foam laid before depositing the reinforcement material, a second layer of pulp fibers is foam laid on, foam laying of microfibers and hydroentanglement in the same way as in FIG. 1. In this embodiment, there is, in addition to the stages of FIG. 1, an initial wet-laying stage in which a head box 10' deposits aqueous foam containing pulp fibers 11' onto the forming fabric 3. The aqueous foam is supplied via a supply line 14 and may come from the same mixing tank 4 which supplies the aqueous foam containing pulp fibers for the later wet-laying stage via supply line 14 to head box 10. Excess aqueous foam is drained through the forming fabric 3 by suction boxes 12', and may be de-aerated and returned to the mixing tank 4 in the same way as the excess foam of the later wet-laying stage.

In alternative embodiments, different foams or liquids could be used for the initial foam-laying stage by head box 10' and the later foam-laying stage by head box 10, in which case they would be supplied from different mixing tanks.

In some embodiments, the additional wet-laying stage may also occur after the process steps shown in FIG. 1 e.g., subsequent to hydroentanglement. Specifically, the three-component material 24 may be turned over and the head box 10' made to deposit the aqueous foam containing pulp fibers 11' on the back side of the material 24, thereby producing additional hydroentanglement before moving the material to the drying stage 25.

FIG. 4 schematically shows a cross-section of a nonwoven composite sheet material 26' that may be formed using the equipment shown in FIG. 3. Material 26' comprises a reinforcement layer 27 sandwiched (i.e., interposed) between a pulp layer 28' (bottom side in the figure) and an additional pulp layer 28 on the opposite side (top side in the figure). Material 26' also comprises a microfiber surface layer 29. The pulp fibers of layers 28 ad 28' are entangled with the reinforcement filaments of reinforcement layer 27, while the microfibers of microfiber layer 29 are entangled with the pulp fibers of pulp layer 28. The material 26' has different surface textures on its two opposite sides, specifically having a rougher or more abrasive surface formed by the pulp layer 28' at the bottom side of the reinforcement layer 27 relative to the microfiber surface layer 29 at the top side of the material 26'. As a result, the sheet 26' is provided with bifunctional characteristics and may be versatile in use for cleaning applications. The soft and smooth microfiber layer top side may be efficient in deep cleaning and is also suitable for polishing purposes. The rough and abrasive pulp layer bottom side may be more suitable for scrubbing.

The pulp layers 28 and 28' may have the same properties (pulp fiber material, thickness etc.) or different properties.

EXAMPLES, TEST METHODS AND TEST RESULTS

A composite nonwoven sheet material according to embodiments of the disclosure with different compositions was produced and tested and compared with comparative examples with respect to cleaning performance and liquid absorption capacity. The total basis weight of the composite nonwoven sheet material was around 65 g/m$^2$ (gsm). The basis weight as measured herein is measured using a material conditioned at 23 °C, 50% RH (Relative Humidity) according to ISO 187.

Example According to the Present Disclosure

An example of a composite nonwoven sheet material was manufactured using equipment as shown in FIG. 1. A 0.4 m wide web of spunlaid polypropylene filaments was laid down onto an endless forming fabric 1 at 15 m/min such that the filaments 2 were not bonded to each other. The web of spunlaid filaments 2 has a weight of 16.3 gsm and an average diameter of 18 μm. In the first wet-laying stage an aqueous foam comprising pulp fibers was wet-laid on the web of spunlaid filaments, excess aqueous foam being sucked off. The wetlaid pulp fibers have a dry weight of 39 gsm. In the second wet-laying stage microfibers 9.8 gsm 0.3 Dtex 5 mm PET fiber (325-0003 PSF from Fiberpartner ApS) was wetlaid on top of the pulp layer, excess aqueous foam being sucked off through the forming fabric. The intermediate product was then moved to a hydroentanglement stage where the spunlaid filaments, pulp fibers and microfibers were integrated with two manifolds at a pressure of 60 bar using a single row of nozzles 19 (120 μm inlet hole and a pitch of 0.6 mm) at 15 meter/minute while being supported by the fabric. The energy supply at the hydroentangling was about 288 kWh/ton of the treated material. The thus obtained material was then dried and rolled.

Comparative Example 1: Sheet Material not Comprising Microfibers

Tork Industrial Cleaning Cloth commercially available from Essity under article no 520378. Basis weight 65 gsm sheet, 63 wt % pulp fibers 24 wt % PP spunlaid filaments 18 μm and 8 wt % PET staple fibers 1.7 dtex, 6 mm.

Comparative Example 2: Sheet Material Containing Microfibers

The second comparative example provides a single-layer 45 gsm microfiber sheet comprising 70 wt. % polyester and 30 wt. % polyamide microfibers.

Test Methods

Test Method 1: Cleaning Efficiency of Fingerprints on Mirror Surface

Figure 5:
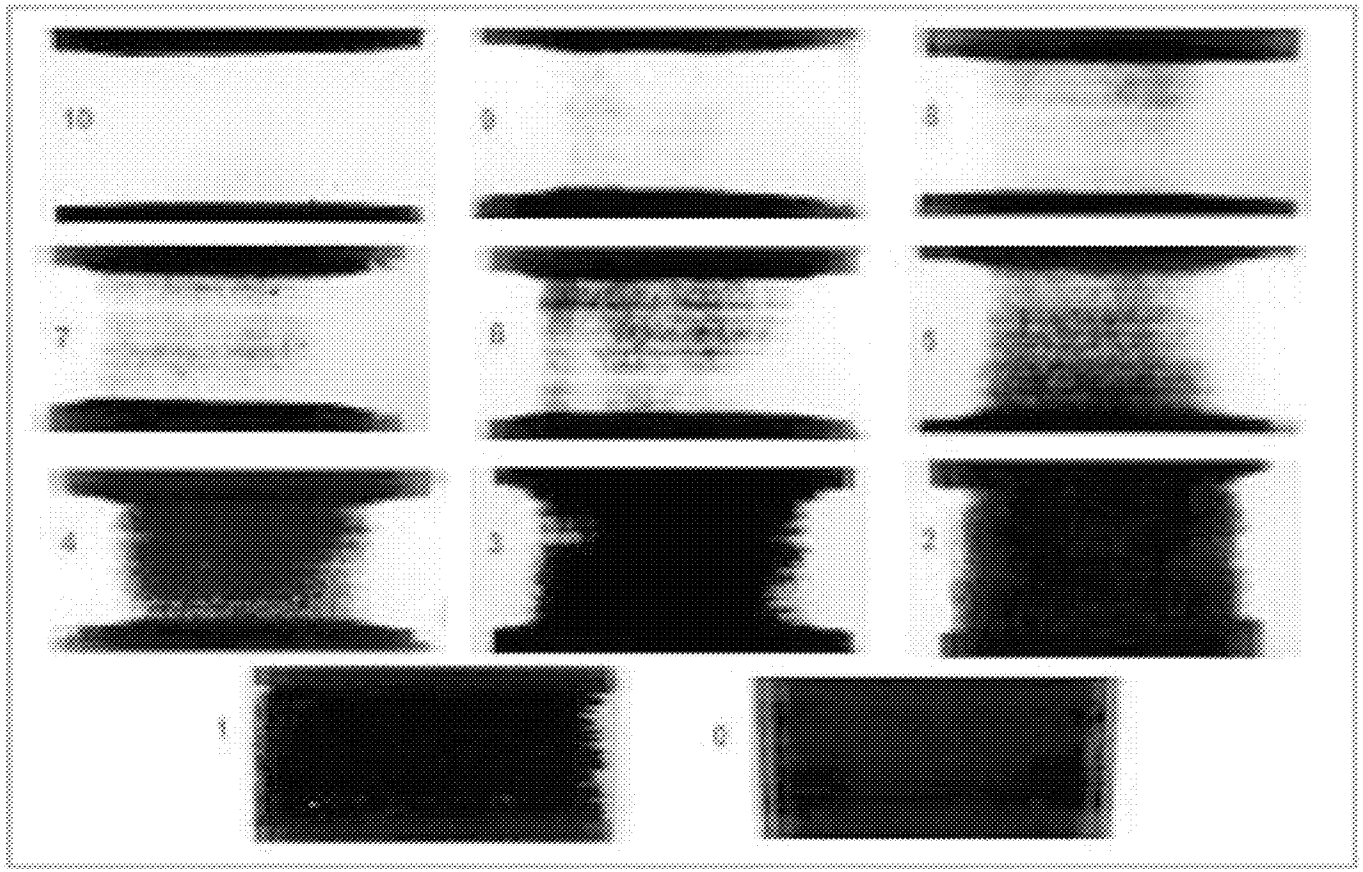
FIG. 5 is a representation of the Fresenius scale used for grading the cleaning efficiency of a sheet or wipe in accordance with embodiments of the disclosure.

In this test method, the Cleaning Efficiency (CE) of different materials is evaluated. The soil used in the method is a coconut butter to simulate fingerprints on a polished surface. The coconut butter is spread on a mirror using a roller applicator. The dirt is wiped off with a Wet Abrasion Scrub Tester (from Sheen Instruments, model 903PG) testing four replicates per sample. Iron oxide powder ($Fe_2O_3$) is applied to the surface for detection purposes and visual assessment is performed according to Fresenius scale as depicted in FIG. 5. The iron oxide powder is a standard pigment used in a color called Iron oxide black (Järnoxidsvart 1A-4950).

Preparation of the Dirt

The coconut butter used is Unilever Cocos (100% coconut, Unilever Sweden) and must be thawed in room temperature one hour prior to application.

Preparation of the dirt: A roller applicator is used for an even application spreading the coconut butter on two mirror surfaces.

Preparation of Test Samples

The material should be tested in dry condition and the wiping movement should be performed in the machine direction (MD) of the samples with punch size of 15×18 cm. The exposed area for testing will be about 35×90 mm.

Test Procedure

Clean mirror plates (16×43.5 cm) are prepared with coconut butter (0.011 g per surface) and fastened in the Sheen equipment for testing. The Sheen equipment has four sample holders each loaded with a 500 g of weight. The test material is wrapped around each sample holder with an elastic band. Wiping is made in machine direction. Adjust the setting to four wiping motions (30 CPM on the machine used for the test) i.e., eight in total back and forth. After the test, iron oxide ($Fe_2O_3$) is applied to the surface and the excess powder is removed. Grade the CE according to the Fresenius scale.

Calculation and Expression of Results

The mean value for the 4 replicates is calculated and this value is reported with one decimal. A high Fresenius value indicates a wipe with good CE and a low Fresenius value indicates a wipe with poor CE. Fresenius scale is from 0-10, where 0 is extremely poor CE and 10 is excellent CE. See FIG. 5.

Test Method 2: Cleaning Efficiency using Wet Wipes

In this test method, the Cleaning Efficiency (CE) of different materials is evaluated using the same equipment as in Test Method 1. The soil used in the method is a kitchen like soil containing a mixture of egg yolk, milk, oil and blankophor. The soil is mixed thoroughly and spread on a steel plate, in a 0.25 mm thick layer. The plate is dried in a climate room (23 °C and 50% Relative Humidity, RH) for 1 hour and 15 minutes. After drying, the plates are photographed in a UV cabinet ("before picture"). The dirt is wiped off with a wet wipe and the plate is photographed again ("after picture"). Blankophor is added for detection purposes. When blankophor is exposed to UV light it emits blue light and this property is used by comparing the emitted blue light before and after wiping. For evaluation, the photos are converted to greyscale and analyzed with an image software and before and after wiping values are compared.

Preparation of the Dirt

Preparation of blankophor solution: 0.125 g blankophor (Bayer) is weighed and dissolved in 50 ml distilled water, thereby yielding a concentration of 2.1 mmol/l. The solution is kept in the dark and stored in a refrigerator. The solution should be shaken before use.

Preparation of egg yolk: Egg yolks from tetra packs (Kronägg) are pre-divided into 20 ml portions in plastic bags or plastic tubes and stored in a freezer (−20 °C) for at least 48 hours before the experiment.

Preparation of the dirt: Mix 20 ml egg yolk and 3 ml oil (olive oil, pure virgin, Acros Organics). Dissolve 3 g milk powder (Semper) with 10 ml water. Mix the egg-oil mixture and the milk and thoroughly in a plastic tube and add 0.5 ml Blankophor solution. To avoid air bubbles the soil preparation is allowed to rest for about 30 minutes.

Preparation of Test Samples

The material to be tested should have a size of about 15×20 cm, always test the sheets in MD (Machine Direction). Dry sheets may be loaded with a defined amount of water by multiplying the dry weight of the material with the liquid loading (LL) needed e.g., 3.0 g*2.5=7.5 ml water is to be added to get a LL of 250%. The loading is preferably made by hand by weighing the dry material, soaking in water and squeezing out liquid by hand until the weight of the sheet corresponds to the precalculated LL.

Test Procedure

Clean steel plates (SS 2343, 15×15 cm) are cleaned in a dish washer. 1.5 ml of the dirt is applied with a pipette on each plate. The soil is spread out on the plates with a spatula by applying a force between 3 and 4 kg to form a soil film with a thickness of about 0.25 mm. Care should be taken that the soil is evenly distributed on the surface without rupture in the soil film.

After the plates have been dried for 1 h and 15 minutes, a photo of the plates is taken in a UV cabinet. This photo is referred to as the "before picture". To have a constant area a black frame made in paper, 15×15 cm with an open area of 5×5 cm is applied on the soil film. The camera used is a Canon Powershot camera (Aperture, F:2.8, Exposure time ¼ sec).

To perform the wiping tests, the plates are fastened on a table with tape. The material to be tested is wrapped around a wiping block with a gummed side (with the gummed side oriented down to the steel plate) and fastened with a clamp, wiping is made in the machine direction (MD). To get more force applied and to mimic the force applied when the wiping is done manually, 800 g extra weights are applied to the wiping block. The wiping speed is 0.1 m/s. The wiping is done twice in the same direction using the same material. After wiping, the steel plate is dried at room temperature for about 5 minutes before a photo is taken in the UV cabinet under the same conditions as the "before picture." The photo is referred to as the "after picture." Each sample is tested in 8 replicates.

Calculation and Expression of Results

The "before picture" and the "after picture" are analyzed with image software using Image pro 6.2 (Image analysis program from Media Cybernetics, Inc) and greyscale values of the dirt (initial and after) are calculated. The wet wipe gets a CE value in percentage calculated as follows:

CE Value (%)=(before picture−after picture)/before picture*100

The mean value for the 8 replicates is calculated and this value is reported with one decimal. A high % value indicates a wipe with good CE and a low % value indicates a wipe with poor CE.

Test Method 3: Liquid Absorption Capacity Measurement

The liquid absorption capacity is determined following the DIN 54540-4 standard with the deviation that soaking the samples is done by hanging vertically instead of laying them horizontally.

Test Method 4: Liquid Release Capacity Measurement

The purpose of this method is to quantify the amount of liquid that is released and available to clean a surface when a wipe is subjected to pressure. A pressures of 1.5 kg was used. 1.5 kg is supposed to mimic ordinary wiping activities.

The method may be used to obtain the liquid release from already commercial wet wipes. Dry material may also be loaded with a defined amount of liquid prior to testing. If the material is loaded before testing, the wipes are conditioned for 6 days before the test, to make sure that the liquid is evenly distributed into the material.

Principle

The amount of liquid released under a certain pressure is measured. Liquid release is defined as the percentage of the loaded liquid in the test piece that is released under pressure. The liquid release was tested using a weight of 1.5 kg applied for 10 s. The weight is thereafter removed.

Preparation Before Test

The following steps are taken before evaluating the liquid release. For commercial wipes only step 1-3:

1. Punch test pieces with the dimensions of 100×100 mm
2. Number the test pieces and weigh them individually
3. Number and weigh the conditioned filter papers (used filter paper: grade 989 Ahlstrom-Munksjö).
4. Impregnate the test pieces with the amount water needed to obtain the target liquid loading (e.g., 3 g liquid/g test piece).
5. The impregnated test pieces are kept in an aluminum foil package for at least one hour before testing.

Procedure to Evaluate Liquid Release:

Liquid release is tested as follows:

1. Weigh the wet test piece, use a scale with accuracy 0.001 g
2. Weigh the dry filter paper, use a scale with accuracy 0.001 g
3. Place the dry filter paper on the wet test piece
4. Place the weight on top of the filter paper and leave it there for 10 seconds.
5. Measure the weight of the filter paper The following parameters are noted:

Dry weight of the test piece

Wet weight of the test piece

Dry weight of the filter paper

Wet weight of the filter paper

The following parameters are calculated:

Liquid loaded (g) (wet test piece−dry test piece)

Liquid loading (%) (liquid loaded/dry test piece*100)

Liquid released (g) (wet filter paper−dry filter paper)

Liquid release (%) (liquid released/liquid loaded*100)

Test Results

Cleaning Performance

The cleaning performance of a composite nonwoven material sheet according to the present disclosure is tested using Test Method 1, Test Method 2, Test Method 3, and Test Method 4, as described above, and was compared with the cleaning performance of the two comparative examples identified above.

The cleaning performance results obtained by the different cleaning test methods are displayed in Table 1.

TABLE 1

Cleaning performance of the samples

| Method/material | Unit | Example (acc. to disclosure) | Comparative example 1 | Comparative example 2 |
|---|---|---|---|---|
| Sheen fingerprint (test 1) | Grade | 7.7 | 4.9 | 9.6 |
| Sheen egg & milk (test 2) | Grade | 9.5 | 7.4 | 6.5 |
| Absorption (test 3) | (g/g) | 6.4 | 5.8 | 3.1 |
| Liquid release (test 4) | (%) | 55 | 60 | 27 |

As shown in Table 1, the Example has an overall better cleaning performance in the four tests relative to comparative example 1 and comparative example 2.

The invention claimed is:

1. A composite nonwoven sheet material for wiping comprising:

a reinforcement layer comprising mainly reinforcement filaments made up from spunlaid filaments which are made by a process that includes directly depositing the fibers in situ, onto a forming fabric, to form a web that is subsequently bonded, a pulp layer comprising mainly pulp fibers formed by depositing an aqueous foam containing the pulp fibers on the reinforcement layer, and a surface layer formed by depositing an aqueous foam containing mainly splittable microfibers on the pulp layer, wherein at least some of the splittable microfibers are split during the formation of the sheet material, and wherein the three layers are hydroentangled together with water jets applied to the three layers of sheet material from the side of the surface layer;

wherein the pulp layer is interposed between the reinforcement layer and the surface layer;

wherein the pulp fibers are entangled with the reinforcement filaments and the microfibers, and the pulp fibers and the microfibers each penetrate the reinforcement layer; and wherein the surface layer is softer and smoother than the reinforcement layer; and wherein the microfibers have a mass density of 1 dtex or less;

wherein:

the pulp layer includes at least about 50 wt. % of pulp fibers, which forms at least to about 10% of the cross-section of the material; and the surface layer includes at least about 50 wt. % of microfibers, which forms at least to the outermost 5% of the cross-section of the material.

2. The sheet material according to claim 1, wherein the pulp fibers have fiber lengths between 1 and 6 mm.

3. The sheet material according to claim 1, wherein the microfibers have a length of 18 mm or less.

4. The sheet material according to claim 1, wherein the reinforcement filaments comprise synthetic filaments of thermoplastic polymers.

5. The sheet material according to claim 1, wherein the sheet material comprises 25-80 wt. % of pulp fibers, 10-40 wt. % of reinforcement filaments and 10-40 wt. % of microfibers.

6. The sheet material according to claim 5, wherein the sheet material comprises 40-65 wt. % of pulp fibers, 15-30 wt. % of reinforcement filaments and 15-30 wt. % of microfibers.

7. The sheet material according to claim 1, further comprising another pulp layer on a side of the reinforcement layer opposite the pulp layer.

8. A process of producing a composite nonwoven sheet material according to claim 1, comprising:

forming the reinforcement layer on a forming fabric;

forming the pulp layer on the reinforcement layer by depositing an aqueous foam containing the pulp fibers on the reinforcement layer;

forming the surface layer on the pulp layer by depositing an aqueous foam containing the microfibers on the pulp layer; and hydroentangling the three layers together;

wherein the pulp layer is interposed between the reinforcement layer and the surface layer;

wherein the pulp fibers are entangled with the reinforcement filaments and the microfibers and the pulp fibers and the microfibers each penetrate the reinforcement layer.

9. The process according to claim 8, wherein the forming of the fibrous web comprises:

a) providing the reinforcement layer comprising mainly reinforcement filaments;

b) applying pulp fibers above the reinforcement material by wet laying, foam laying or air laying, for forming the pulp layer; and c) applying microfibers or splittable fibers for providing microfibers above the pulp layer by wet laying, foam laying, dry laying or air laying, for forming the surface layer; and wherein step b) comprises hydroentangling the reinforcement layer, pulp layer and surface layer to obtain the composite nonwoven sheet material.

10. The process according to claim 9, wherein step e) comprises applying splittable fibers and wherein at least a major part of the splittable fibers are split by the hydroentangling in step f), thereby forming the microfibers.

11. The process according to claim 8, wherein the forming of the fibrous web comprises forming an additional pulp layer on an opposite side of the reinforcement layer.

12. A wipe comprising at least one ply of a composite nonwoven sheet material comprising a reinforcement layer comprising mainly reinforcement filaments, a pulp layer comprising mainly pulp fibers, and a surface layer comprising mainly microfibers, wherein the pulp layer is interposed between the reinforcement layer and the surface layer, and wherein the pulp fibers are entangled with the reinforcement filaments and the microfibers or produced by a process according to claim 9.

13. The wipe of claim 12 having a liquid absorption capacity of at least 6.0 g/g according to the DIN 54540-4 standard.

14. The wipe of claim 12 having a liquid release of at least 50% according to the test method described herein.

15. The wipe of claim 12, having a cleaning efficiency of fingerprints of at least grade 6.0 according to the test method described herein.

16. The sheet material according to claim 1, wherein the reinforcement filaments comprise synthetic filaments of polyolefins, polyesters or polylactides.

17. The sheet material according to claim 1, wherein the pulp layer comprises at least 50% by weight pulp fibers and the surface layer comprises at least 50% by weight microfibers.

18. The sheet material according to claim 1, wherein the microfibers have a mass density of 0.5 dtex or less.

19. The sheet material according to claim 1, wherein the microfibers have a mass density of 0.35 dtex or less.

20. The sheet material according to claim 1, wherein the pulp layer includes coarse staple fibers in a range between about 1 wt. % and about 30 wt. % of the combined total of pulp, reinforcement material (filaments), microfibers and coarse staple fibers.

* * * * *